United States Patent [19]

Wallbank

[11] Patent Number: 4,854,366

[45] Date of Patent: Aug. 8, 1989

[54] METHOD OF MAKING A MOULDED ARTICLE

[75] Inventor: James Wallbank, Birmingham, United Kingdom

[73] Assignee: Austin Rover Group Limited, England

[21] Appl. No.: 223,228

[22] Filed: Jul. 22, 1988

[30] Foreign Application Priority Data

Aug. 5, 1987 [GB] United Kingdom ..... 8718546

[51] Int. Cl.[4] ..... B22C 7/00; B22C 1/22

[52] U.S. Cl. ..... 164/16; 164/45

[58] Field of Search ..... 164/14, 15, 16, 44, 164/45

[56] References Cited

FOREIGN PATENT DOCUMENTS

| | | | |
|---|---|---|---|
| 1901858 | 8/1970 | Fed. Rep. of Germany | 164/14 |
| 51-17934 | 6/1976 | Japan | 164/15 |
| 55-84247 | 6/1980 | Japan | 164/15 |

*Primary Examiner*—Kuang Y. Lin

*Attorney, Agent, or Firm*—Davis, Bujold & Streck

[57] ABSTRACT

In the production of moulds for making moulded articles, eg foundry moulds for producing castings, it is known to consolidate resin-coated granular filler in a moulding box containing a pattern to form the mould pieces. A gas such as $SO_2$ is passed through the filler to cause it to set. However, after repeated use, resin buildings up on the pattern plate. According to the invention, the pattern is provided with a layer of silicone release agent such as siloxane which prevents resin build-up yet can be easily washed away.

6 Claims, No Drawings

METHOD OF MAKING A MOULDED ARTICLE

BACKGROUND TO THE INVENTION

This invention relates to the production of moulds, and moulded articles, and in particular to the production of foundry moulds for casting metals.

One of the most promising techniques in recent years for the production of moulds and cores for use in the foundry in recent years is a process known as the $SO_2$ process. In this method, a moulding composition comprising a granular filler and an acid-curing synthetic resin is cured by the use of a gas, such as $SO_2$, which produces $H_2SO_4$ in situ, to cause the resin to cure. This process is described in detail in British Patent Specification No. 14411975.

Although, in principle, the $SO_2$ process is capable of providing very accurate and reproducable moulds and cores, at high throughput rates, in practice it has had only very limited application.

The reason for the limited practical application of the process is that it is found that, when a pattern is used repeatedly, as is necessary in a production process to achieve the necessary throughput, a build-up of a dark residue layer takes place on the surface of the pattern exposed to the moulding mixture. This build-up can take place very rapidly, so that it is not possible to use the pattern continuously to produce more than, typically, about eighty moulds. After this time, the build-up is of such a thickness that the dimensions of the mould are unacceptably altered.

Furthermore, it is found that the build-up is very difficult to remove, and previously was only removable with brush abrasives, such as wire wool. The repeated use of such abrasive cleaning agents is highly undesirable, because over a relatively short period, it results in the dimensions of the pattern, and its surface finish, being altered. In practical terms, it might be desirable to produce eight hundred or so moulded articles during a single shift, whithout subjecting the pattern to a cleaning operation. Existing techniques mean that the maximum number of times which the pattern can be used before it needs to be cleaned is very much less than this. Thus it is necessary to provide, for each shift, two sets of patterns, one of which is being cleaned, whilst the other is in use. This results in very substantially increased costs, both for the production on an additional set of tooling, and in the labour required.

Although the rapid build-up of the deposit on the pattern is undesirable, for the reasons outlined above, the deposition of small amounts of the deposit are found to be very beneficial. When a new pattern is used for the first time, before the deposit has had time to form, it is found that sand grains stick to the surface, even though release agents are applied. This can render the first ten or so articles produced from the pattern unusable. As a small amount of the deposit forms, the sand sticking is reduced considerably.

We have conducted intensive investigations to determine methods of treating the pattern in a process of the kind described above, so as to retard (but not to prevent completely), the build-up of the deposit, and so as also to enable the pattern to be cleaned with non-abrasive cleaning agent, when the build-up has reached an unacceptable level. As a consequence, we have determined that by treating the pattern with a silicone, preferably a siloxane, more preferably a polydialkyl siloxane, such as polydimethyl siloxane, it is possible to retard the build-up of the deposit considerably, and also to permit the removal of the build-up by the use of a non-abrasive cleaning agent, when this eventually becomes necessary.

SUMMARY OF THE INVENTION

According to the invention there is provided a process of manufacture of a moulded article including the steps of forming a pattern with the shape of the moulded article to be manufactured, using the pattern by providing the surface thereof with a layer of silicone release agent, packing a composition of a mixture of granular filler and an acid-curing synthetic resin against the pattern, curing in situ the synthetic resin in contact with the pattern in the presence of a gas adapted to form a said moulded article, separating the pattern from the moulded article so formed, and repeatedly re-using the pattern as above and periodically cleaning same by washing with a non-abrasive cleaning agent to remove build up of deposits formed thereon.

The use of a layer of silicone release agent on the pattern provides the unexpected advantage of a large reduction in the rate of growth of the build up of deposits thereon; and also enables the build up of deposits to be removed without the use of abrasive cleaning means.

The pattern is preferably cleaned using warm water, a non-abrasive wiper, such as a soft cloth and it is generally found that the deposit formed in the $SO_2$ process can be readily removed by this method, without the need for abrasive cleaning agents. The washing step is preferably carried out after approximately 500 to 1000 uses of the pattern, preferably about 800 uses.

Although the pattern can be cleaned simply with warm water, small amounts of various acid or alkaline additives may be incorporated in the washing water, to facilitate the stripping process. Examples of suitable materials which may be incorporated in the washing water are citric acid, acetic acid, boric acid and orthophosphoric acid, alkylis such as caustic soda, and organic solvents such as acetone, methanol and ethanol.

In a particularly preferred embodiment, approximately 5% by weight of methylated spirit may be incorporated into the washing water.

A preferred embodiment of the invention is described in the following example.

EXAMPLE

The build-up of a black deposit on an aluminium pattern in the $SO_2$ process as described in British Patent Specification No. 1411975 was investigated as follows. An aluminium pattern was thoroughly cleaned and degreased, and was then sprayed with an aerosol formulation of a polydialkyl siloxane mould release agent in an organic solvent base ("ADSIL" silicone).

The siloxane was allowed to dry, and was then utilised in the production of moulds for casting metal.

The moulding composition used comprised zircon sand, (500 micrometers mesh size), comprising 0.7% by weight of a phenolic resin (FORDATH HARDOX FH100), and 0.245% of a perioxide (catox MEKP). The resin was cured by gassing with $SO_2$, for one second. After each use of the pattern, the force required to remove it from the mould, and the thickness of the deposit formed on the pattern, were measured. The results are shown in Table 1.

The test was repeated, utilising a conventional wax mould release agent, sold for use in such processes (W80, marketed by S H Baron Limited). The force required to remove the pattern, and the thickness of the deposit were again measured, and the results are also shown in Table 1.

As can be seen from Table 1, the thickness of the build-up observed when the silicone release agent was employed was less than that produced when the wax mould release agent was employed, by a factor of about 15:1.

It was found that the silicone release agent could be utilised continuously to produce approximately 800 moulds, that is to say the number of moulds which might typically be produced during a working shift.

It was also noted during the experiment that a film build-up of a few microns in thickness minimises the sticking of sand to the pattern, and substantially facilitates stripping the pattern from the mould.

After the pattern had in each case been used for a period such that a deposit of about 10 microns in thickness had been formed, attempts were made to clean the pattern, by washing it in a solution containing about 5% by volume methylated spirit in water, at about 50° C. It was found that the pattern which had been treated with the polydimethy siloxane release agent was readily cleaned, and the deposit which had been formed was removed by mild rubbing with cotton wool. However, the pattern which had been treated with the wax mould release agent was far more difficult to clean, and required scouring with wire wool.

A wide range of variations from the process described specifically above are possible, within the scope of the appended claims.

TABLE 1

| | Siloxane Mould Release Agent (ADSIL) | | Wax Mould Release Agent (W80) | |
|---|---|---|---|---|
| Number of Uses | Force (KN) | Thickness (mm) | Force (KN) | Thickness (mm) |
| 2 | 0.55 | (1) | 0.6 | (1) |
| 4 | 0.34 | (1) | 0.48 | (1) |

TABLE 1-continued

| | Siloxane Mould Release Agent (ADSIL) | | Wax Mould Release Agent (W80) | |
|---|---|---|---|---|
| Number of Uses | Force (KN) | Thickness (mm) | Force (KN) | Thickness (mm) |
| 6 | 0.27 | (1) | 0.35 | (1) |
| 8 | 0.23 | (1) | 0.25 | (1) |
| 10 | 0.20 | .002 | 0.22 | 0.021 |
| 35 | 0.15 | .009 | 0.17 | 0.058 |
| 50 | 0.15 | 0.013 | 0.17 | 0.084 |
| 75 | 0.15 | 0.019 | 0.17 | 0.13 |
| 100 | 0.15 | 0.025 | 0.17 | 0.18 |
| 125 | 0.15 | 0.03 | 0.17 | 0.21 |
| 150 | 0.15 | 0.37 | 0.17 | 0.23 |

(1) Thickness too small to be measured reliably.

I claim:

1. In a process of manufacture of a moulded article including the steps of:

forming a pattern with the shape of the moulded article to be manufactured;

using the pattern by providing the surface thereof with a layer of silicone release agent;

packing a composition of a mixture of granular filler and an acid-curing synthetic resin against the pattern;

curing in situ the synthetic resin in contact with the pattern in the presence of a gas adapted to form a said moulded article separating the pattern from the moulded article so formed; and repeatedly re-using the pattern as above and periodically cleaning same by washing with a non-abrasive cleaning agent to remove build up of deposits formed thereon.

2. In a process as set forth in claim 1, the silicone being a siloxane.

3. In a process as set forth in claim 2, the siloxane being a polydialkyl siloxane.

4. In a process as set forth in claim 3, the polydialkyl siloxane being polydimethyl siloxane.

5. In a process as set forth in claim 1, the washing step is being carried out after between 500 and 1000 uses of the pattern.

6. In a process as set forth in claim 1, the washing being carried out using a solution comprising an aqueous alcohol.

* * * * *